US011739752B2

(12) United States Patent
Choi et al.

(10) Patent No.: US 11,739,752 B2
(45) **Date of Patent: *Aug. 29, 2023**

(54) SCROLL COMPRESSOR WITH BYPASS PORTIONS

(71) Applicant: LG Electronics Inc., Seoul (KR)

(72) Inventors: Yongkyu Choi, Seoul (KR); Inho Won, Seoul (KR); Cheolhwan Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/941,743

(22) Filed: Sep. 9, 2022

(65) Prior Publication Data

US 2023/0003221 A1 Jan. 5, 2023

Related U.S. Application Data

(63) Continuation of application No. 16/848,188, filed on Apr. 14, 2020, now Pat. No. 11,473,579, which is a (Continued)

(30) Foreign Application Priority Data

May 21, 2013 (KR) ..... 10-2013-0057316

(51) Int. Cl.
*F03C 2/00* (2006.01)
*F03C 4/00* (2006.01)
(Continued)

(52) U.S. Cl.
CPC ..... *F04C 18/0261* (2013.01); *F04C 15/06* (2013.01); *F04C 18/0215* (2013.01);
(Continued)

(58) Field of Classification Search
CPC ..... F04C 18/0215; F04C 18/0246; F04C 18/0261; F04C 28/26; F04C 15/06;
(Continued)

(56) References Cited

U.S. PATENT DOCUMENTS 4,818,195 A 4/1989 Murayama et al.
6,379,123 B1 4/2002 Makino et al.
(Continued)

FOREIGN PATENT DOCUMENTS

CN 101675248 3/2010
CN 102052310 5/2011
(Continued)

OTHER PUBLICATIONS

Office Action in U.S. Appl. No. 16/186,221, dated Sep. 17, 2020, 17 pages.
(Continued)

*Primary Examiner* — Theresa Trieu
(74) *Attorney, Agent, or Firm* — Fish & Richardson P.C.

(57) ABSTRACT

A scroll compressor includes a discharge port formed at a central portion thereof, a pair of two compression chambers continuously moving toward the discharge port, and a plurality of bypass portions formed at each interval along a movement path of each compression chamber in the both compression chambers. Compression gradients of the both compression chambers are different from each other. An interval between a bypass portion closest to the discharge port and another bypass portion adjacent to the bypass portion among the bypass portions of each compression chamber is defined as a first interval. The first interval of a second bypass portion belonging to a compression chamber having a relatively larger compression gradient is smaller than the first interval of a first bypass portion belonging to the other compression chamber.

9 Claims, 10 Drawing Sheets

Related U.S. Application Data continuation of application No. 16/186,221, filed on Nov. 9, 2018, now Pat. No. 11,047,386, which is a continuation of application No. 15/624,841, filed on Jun. 16, 2017, now Pat. No. 10,125,767, which is a continuation-in-part of application No. 14/782,080, filed as application No. PCT/KR2014/004460 on May 19, 2014, now Pat. No. 9,683,568.

(51) Int. Cl.

| | |
|---|---|
| ***F04C 2/00*** | (2006.01) |
| ***F04C 18/00*** | (2006.01) |
| ***F04C 18/02*** | (2006.01) |
| ***F04C 23/00*** | (2006.01) |
| ***F04C 28/26*** | (2006.01) |
| ***F04C 15/06*** | (2006.01) |
| ***F04C 29/12*** | (2006.01) |
| *F04C 29/02* | (2006.01) |

(52) U.S. Cl.

CPC ..... *F04C 18/0246* (2013.01); *F04C 23/008* (2013.01); *F04C 28/26* (2013.01); *F04C 29/12* (2013.01); *F04C 29/023* (2013.01); *F04C 2210/26* (2013.01); *F04C 2240/40* (2013.01); *F04C 2240/60* (2013.01)

(58) Field of Classification Search

CPC ..... F04C 29/12; F04C 23/008; F01C 1/0215; F01C 1/0261

See application file for complete search history.

(56) References Cited

U.S. PATENT DOCUMENTS

| | | | | |
|---|---|---|---|---|
| 9,683,568 | B2 | 6/2017 | Choi et al. | |
| 10,125,767 | B2 | 11/2018 | Choi et al. | |
| 11,047,386 | B2 | 6/2021 | Choi et al. | |
| 11,473,579 | B2 * | 10/2022 | Choi ..... | F04C 18/0261 |
| 2003/0219351 | A1 | 11/2003 | Hiwata et al. | |
| 2010/0221133 | A1 | 9/2010 | Nishikawa et al. | |
| 2013/0089449 | A1 | 4/2013 | Seong et al. | |

FOREIGN PATENT DOCUMENTS

| | | |
|---|---|---|
| CN | 102297132 | 12/2011 |
| CN | 103016341 | 4/2013 |
| CN | 103047136 | 4/2013 |
| JP | H04255589 | 9/1992 |
| JP | H09217690 | 8/1997 |
| JP | 2001200795 | 7/2001 |
| KR | 20090040146 | 4/2009 |
| KR | 20130031737 | 3/2013 |
| KR | 1020130031735 | 3/2013 |
| KR | 1020130031736 | 3/2013 |
| WO | WO2014189240 | 11/2014 |

OTHER PUBLICATIONS

Chinese Office Action dated Aug. 15, 2016 issued in Application No. 201480024407.6 (with English Translation).

International Search Report and Written Opinion dated Sep. 23, 2014 issued in Application No. PCT/KR2014/004460.

* cited by examiner

SCROLL COMPRESSOR WITH BYPASS PORTIONS

CROSS-REFERENCE TO RELATED APPLICATIONS

This application is a continuation of U.S. application Ser. No. 16/848,188, filed on Apr. 14, 2020, now U.S. Pat. No. 11,473,579, which is a continuation of U.S. application Ser. No. 16/186,221, filed on Nov. 9, 2018, now U.S. Pat. No. 11,047,386, which is a continuation of U.S. application Ser. No. 15/624,841, filed on Jun. 16, 2017, now U.S. Pat. No. 10,125,767, which is a continuation-in-part of U.S. application Ser. No. 14/782,080 filed on Oct. 2, 2015, now U.S. Pat. No. 9,683,568, which is a National Stage Application under 35 U.S.C. § 371 of PCT Application No. PCT/KR2014/004460, filed May 19, 2014, which claims priority under 35 U.S.C. 119(a) to Application No. 10-2013-0057316, filed in the Republic of Korea on May 21, 2013, all of which are hereby expressly incorporated by reference into the present invention.

TECHNICAL FIELD

The present disclosure relates to a scroll compressor, and more particularly, to a bypass hole for bypassing a part of refrigerant compressed prior to discharge.

BACKGROUND

The scroll compressor is a compressor forming a compression chamber made of a suction chamber, an intermediate pressure chamber, and a discharge chamber between both scrolls while performing a relative orbiting motion in engagement with a plurality of scrolls. Such a scroll compressor may obtain a relatively high compression ratio as compared with other types of compressors while smoothly connecting suction, compression, and discharge strokes of refrigerant, thereby obtaining stable torque. Therefore, the scroll compressor is widely used for compressing refrigerant in an air conditioner or the like. Recently, a high-efficiency scroll compressor having a lower eccentric load and an operation speed at 180 Hz or higher has been introduced.

The behavior characteristics of the scroll compressor may be determined by the shape of a fixed wrap and an orbiting wrap. The fixed wrap and the orbiting wrap may have any shape, but usually have a form of an involute curve that can be easily processed. The involute curve denotes a curve corresponding to a trajectory drawn by an end of thread when the thread wound around a base circle having an arbitrary radius is released. When the involute curve is used, a thickness of the wrap is constant and a capacity change rate may be also constant, and therefore, a number of turns of the wrap should be increased to obtain a high compression ratio, but in this case, it has a drawback in which a size of the compressor also increases.

Furthermore, the orbiting scroll is typically formed on one lateral surface of a circular disk-shaped end plate and the orbiting wrap, and a boss portion is formed on a rear surface that is not formed with the orbiting wrap and connected to a rotation shaft for orbitally driving the orbiting scroll. Such a shape may form an orbiting wrap over a substantially overall area of the end plate, thereby decreasing a diameter of the end plate portion for obtaining the same compression ratio. On the contrary, an action point to which a repulsive force of refrigerant is applied and an action point to which a reaction force for cancelling out the repulsive force is applied are separated from each other in a vertical direction, thereby causing a problem of increasing vibration or noise while the behavior of the orbiting scroll becomes unstable during the operation process.

In view of this, there is known a so-called axial through scroll compressor in which a point where the rotating shaft and the orbiting scroll are combined overlap with the orbiting wrap in a radial direction. In such an axial through scroll compressor, an action point of a repulsive force of refrigerant and an action point of the reaction force may act on the same point, thereby greatly reducing a problem of the inclination of the orbiting scroll.

On the other hand, according to the above-described axial through scroll compressor, a bypass hole may be formed in the middle of the compression chamber similarly to a typical scroll compressor to discharge a part of refrigerant to be compressed in advance. Through this, it may be possible to prevent over compression that may occur due to excessive inflow of liquid refrigerant and oil, in advance thereby enhancing compression efficiency as well as securing reliability.

However, in the above-described axial through scroll compressor in the related art, a discharge port may be formed at a position eccentric from the center of the orbiting scroll, thereby causing a difference in flow rate of refrigerant while compression gradients (volume reduction gradients) of both compression chambers become different from each other. In other words, as a compression chamber (hereinafter, referred to as a second compression chamber or a B pocket) having a shorter compression path length between both compression chambers may have a relatively steep compression gradient as compared to a compression chamber (hereinafter, referred to as a first compression chamber or a A pocket) having a longer compression path length, a speed of refrigerant in the second compression chamber may become higher than the speed of refrigerant in the first compression chamber. Accordingly, over compression may occur in the second compression chamber as compared to the first compression chamber, thereby reducing the overall efficiency of the compressor.

However, according to a shaft-through scroll compressor in the related art, bypass holes belonging to both compression chambers may be formed to have the same cross-sectional area at the same rotation angle position, and therefore, a difference in compression gradient with respect to both compression chambers cannot be solved. As a result, over-compression loss may occur in a compression chamber having a larger compression gradient (i.e., second compression chamber) as described above, thereby causing a problem of reducing the overall compression efficiency of the entire compressor.

SUMMARY

An object of the present disclosure is to provide a scroll compressor capable of minimizing over-compression loss in a compression chamber having a large compression gradient when compression gradients (or volume reduction gradients) of both compression chambers are different from each other.

Another object of the present disclosure is to provide a scroll compressor capable of reducing a compression gradient difference between both compression chambers when compression gradients (or volume reduction slopes) of both compression chambers are different from each other.

In order to achieve the foregoing objectives of the present disclosure, there is provided a scroll compressor in which an overall cross-sectional area of second discharge bypass holes formed in a compression chamber having a larger compression gradient or having a larger volume reduction gradient of the compression chamber is formed to be larger than that of first discharge bypass holes formed in a compression chamber having a smaller compression gradient or having a smaller volume reduction gradient of the compression chamber.

Here, an interval of the second discharge bypass holes may be formed to be smaller than that of the first discharge bypass holes within a rotation angle range of up to 180 degrees from an inner end portion of a fixed wrap among wraps forming the compression chambers.

Furthermore, a number of the second discharge bypass holes may be formed to be larger than that of the first discharge bypass holes within a rotation angle range of up to 180 degrees from an inner end portion of a fixed wrap among wraps forming the compression chambers.

In addition, in order to achieve the foregoing objectives of the present disclosure, there is provided a scroll compressor in which a discharge port is provided, and a pair of two compression chambers continuously moving toward the discharge port are formed, and a plurality of bypass portions are formed at each interval along a movement path of each compression chamber in the both compression chambers, and compression gradients of the both compression chambers are formed to be different from each other, wherein when a compression chamber having a relatively smaller compression gradient and a compression chamber having a relatively larger compression gradient between the both compression chambers are defined as a first compression chamber and a second compression chamber, respectively, and bypass portions belonging to the first compression chamber and bypass portions belonging to the second compression chamber are defined as first bypass portions and second bypass portions, respectively, bypass portions closest to the discharge port, among the second bypass portions, have a narrowest interval.

Here, an overall cross-sectional area of the first bypass portion and an overall cross-sectional area of the second bypass portion may be formed to be the same as each other.

Furthermore, the first bypass portion and the second bypass portion may be configured with a plurality of bypass holes, respectively, and the each bypass portion may be configured with the same number of bypass holes.

Furthermore, a number of the first bypass portions and a number of the second bypass portions may include a plurality of bypass holes, respectively, and the cross-sectional areas of the respective bypass holes may be all formed to be the same.

Furthermore, an overall cross-sectional area of the second bypass portion may be formed to be larger than that of the first bypass portion.

Furthermore, the first bypass portion and the second bypass portion may include a plurality of bypass holes, respectively, and the second bypass portion may be formed with a larger number of bypass holes than the first bypass portion.

Here, a plurality of discharge ports may be provided and formed to communicate independently with the each compression chamber.

In addition, in order to achieve the foregoing objectives of the present disclosure, there is provided a scroll compressor, including a first scroll in which a first wrap is formed on one lateral surface of a first plate portion, and a discharge port penetrated in the thickness direction of the first plate portion is eccentrically formed with respect to the center of the first plate portion in the vicinity of an inner end portion of the first wrap, and a plurality of first bypass holes are formed at a predetermined intervals at a plurality of positions, respectively, along an inner surface of the first wrap, and a plurality of second bypass holes are formed at a predetermined intervals at a plurality of positions, respectively, along an outer surface of the first wrap, in a penetrating manner in the thickness direction of the first plate portion between the inner surface and the outer surface of the first wrap; a second scroll in which a second wrap engaged with the first wrap is formed on one lateral surface of a second plate portion, and an inner surface of the first wrap forms a first compression chamber between the inner surface of the first wrap and an outer surface of the second wrap, and an outer surface of the first wrap forms a second compression chamber between the outer surface of the first wrap and an inner surface of the second wrap while performing an orbiting movement with respect to the first scroll; and a rotating shaft having an eccentric portion to be coupled through a central portion of the second scroll to overlap with the second wrap in a radial direction, wherein when bypass holes belonging to the first compression chamber and bypass holes belonging to the second compression chamber are defined as first bypass portions and second bypass portions, respectively, an interval between a bypass portion closest to the discharge port and a next bypass portion adjacent to the bypass portion among the first bypass portions and an interval between a bypass portion closest to the discharge port and a next bypass portion adjacent to the bypass portion among the second bypass portions are defined as a first inner interval, and a first outer interval, respectively, the first outer interval is formed to be smaller than the first inner interval.

Here, wherein the bypass holes may be formed by successively forming at least two or more bypass holes to constitute a plurality of bypass portions, and a number of bypass holes belonging to the one group may be formed to be the same for each group.

Furthermore, wherein the bypass holes may be formed by successively forming at least two or more bypass holes to constitute a plurality of bypass portions, and each cross-sectional area of bypass holes belonging to the one group may be formed to be the same.

Furthermore, a number of groups belonging to the second compression chamber may be formed to be larger than that belonging to the first compression chamber.

Furthermore, a cross-sectional area of the entire bypass holes belonging to the second compression chamber may be formed to be larger than that of the entire bypass holes belonging to the first compression chamber.

Here, the discharge port may include a first discharge port communicating with the first compression chamber; and a second discharge port communicating with the second compression chamber.

Moreover, in order to achieve the foregoing objectives of the present disclosure, there is provided a scroll compressor, including a casing in which oil is stored in an inner space thereof; a drive motor provided in an inner space of the casing; a rotating shaft coupled to the drive motor; a frame provided below the drive motor; a first scroll provided below the frame in which a first wrap is formed one lateral surface a first plate portion, and a discharge port is formed adjacent to a central side end portion of the first wrap, and at least one first bypass hole and at least one second bypass hole are formed around an inner surface of the first wrap and around an outer surface of the first wrap, respectively, and the first bypass holes and the second bypass holes are formed at intervals along the formation direction of the first wrap; and a second scroll provided between the frame and the first scroll in which a second wrap engaged with the first wrap is formed on one lateral surface of the second plate portion, and the rotating shaft is eccentrically coupled to the second wrap to overlap with the second wrap in a radial direction, and a pair of two compression chambers are formed between the second scroll and the first scroll while performing an orbiting movement with respect to the first scroll, wherein an overall cross-sectional area of the second bypass holes may be formed to be larger than an overall cross-sectional area of the first bypass holes within a range of a rotation angle of 180 degrees along the first wrap from an inner end of the first wrap.

Here, an overall cross-sectional area of the first bypass holes may be formed to be the same as that of the second bypass holes.

Furthermore, an overall cross-sectional area of the second bypass holes may be formed to be larger than an overall cross-sectional area of the first bypass holes.

Furthermore, a number of the first bypass holes may be formed to be the same as a number of the second bypass holes.

Furthermore, a number of the second bypass holes may be formed to be larger than that of the first bypass holes within the range.

Furthermore, when the compression chamber to which the first bypass hole belongs and the second bypass hole belongs are respectively defined as a first compression chamber and a second compression chamber between the pair of two compression chambers, and wherein a compression gradient of the second compression chamber may be a larger than that of the second compression chamber.

Here, the discharge port may include a first discharge port communicating with the first compression chamber; and a second discharge port communicating with the second compression chamber.

According to a scroll compressor according to the present disclosure, bypass holes formed in a compression chamber having a larger compression gradient between both compression chambers may be formed at a discharge side in a concentrating manner as compared to bypass holes formed in the other compression chamber to alleviate a compression gradient in a compression chamber having a larger compression gradient so as to prevent over compression, thereby enhancing an overall efficiency of the compressor.

Furthermore, an interval between bypass holes formed in a compression chamber having a larger compression gradient between both compression chambers may be formed at a discharge side to be smaller than that in the other compression chamber to alleviate a compression gradient in a compression chamber having a larger compression gradient so as to prevent over compression, thereby enhancing an overall efficiency of the compressor.

In addition, a cross-sectional area of the entire bypass holes formed in a compression chamber having a larger compression gradient between both compression chambers may be formed at a discharge side to be larger than that in the other compression chamber to alleviate a compression gradient in a compression chamber having a larger compression gradient so as to prevent over compression, thereby enhancing an overall efficiency of the compressor.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION

Hereinafter, a scroll compressor according to the present disclosure will be described in detail with reference to an embodiment illustrated in the accompanying drawings.

In general, a scroll compressor may be divided into a low pressure type in which a suction pipe is communicated with an internal space of a casing constituting a low pressure portion and a high pressure type in which a suction pipe is directly communicated with the compression chamber. Accordingly, in the low pressure type, a drive unit is provided in a suction space which is a low pressure portion, however, in the high pressure type, a drive unit is provided in a discharge space which is a high pressure portion. Such a scroll compressor may be divided into an upper compression type and a lower compression type according to the positions of the drive unit and the compression unit, and it is referred to as an upper compression type when the compression unit is located above the drive unit, and referred to as a lower compression type when the compression unit is located below the drive unit. Hereinafter, a scroll compressor of a type in which a rotating shaft overlaps with an orbiting wrap on the same plane in a lower compression type scroll compressor will be described as a representative example. This type of scroll compressor is known to be suitable for application to refrigeration cycles under high temperature and high compression ratio conditions.

Figure 1:
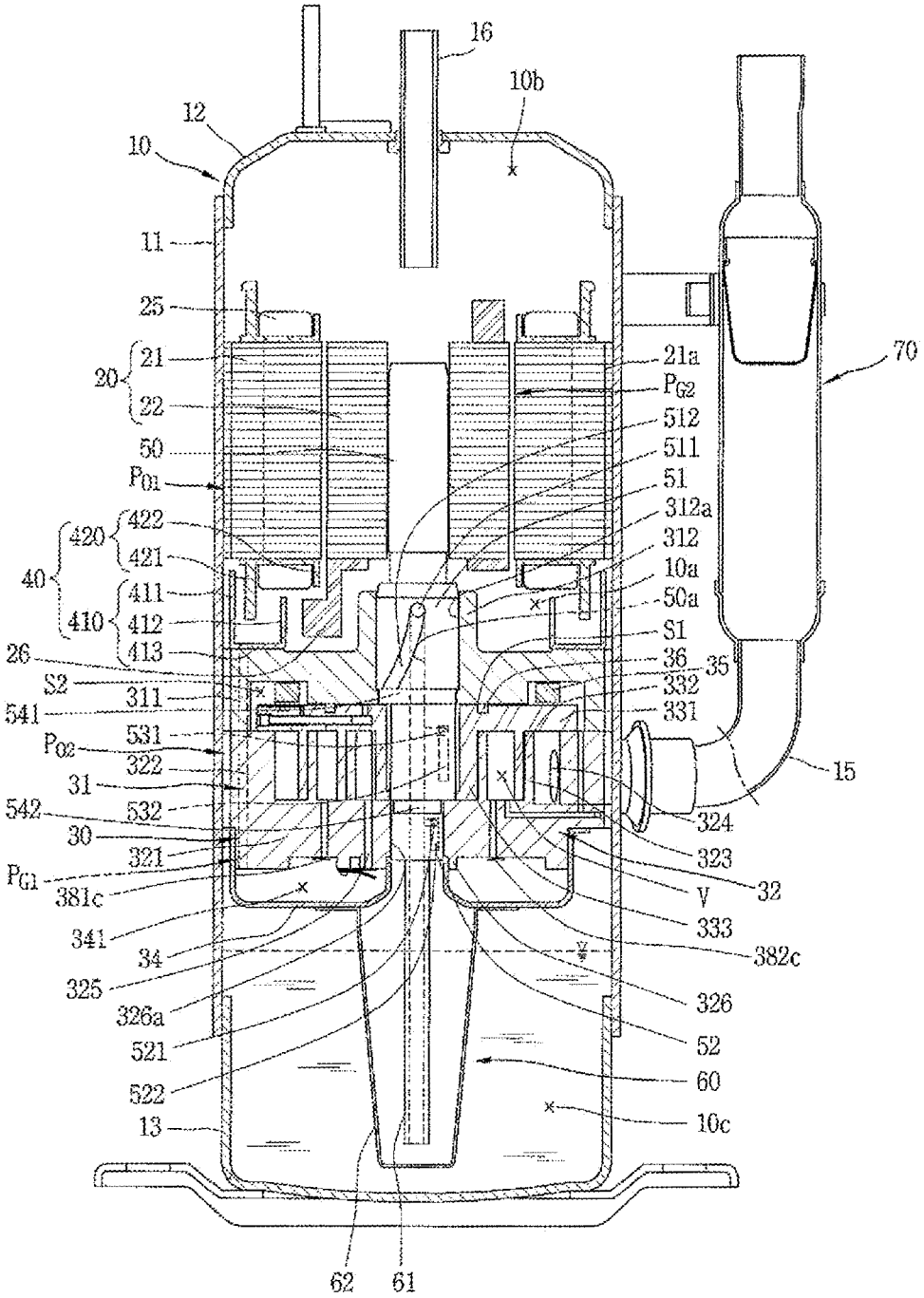
FIG. 1 is a longitudinal sectional view illustrating a lower compression type scroll compressor according to the present disclosure.
Figure 2:
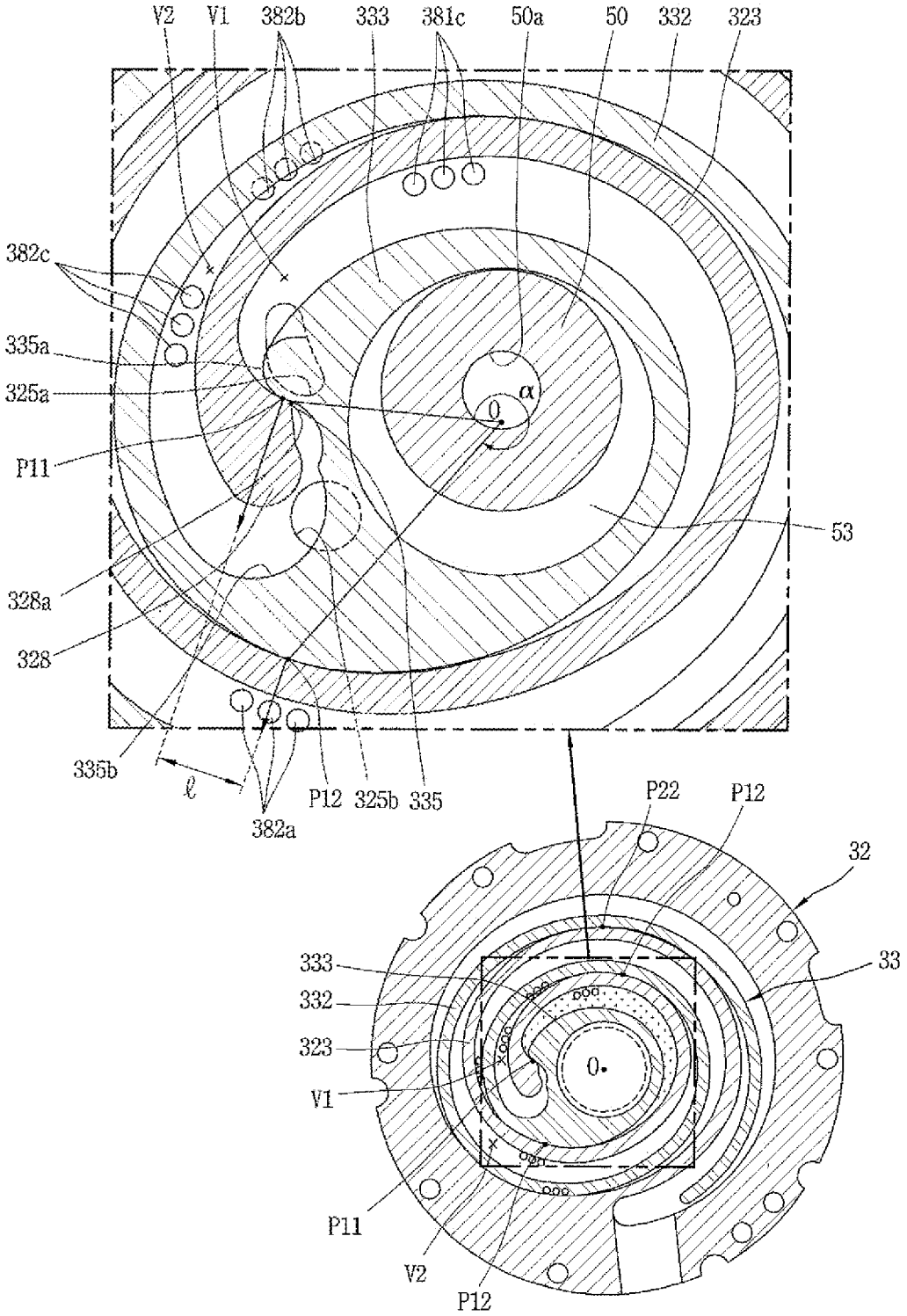
FIG. 2 is a cross-sectional view illustrating a compression portion in FIG. 1.
Figure 3:
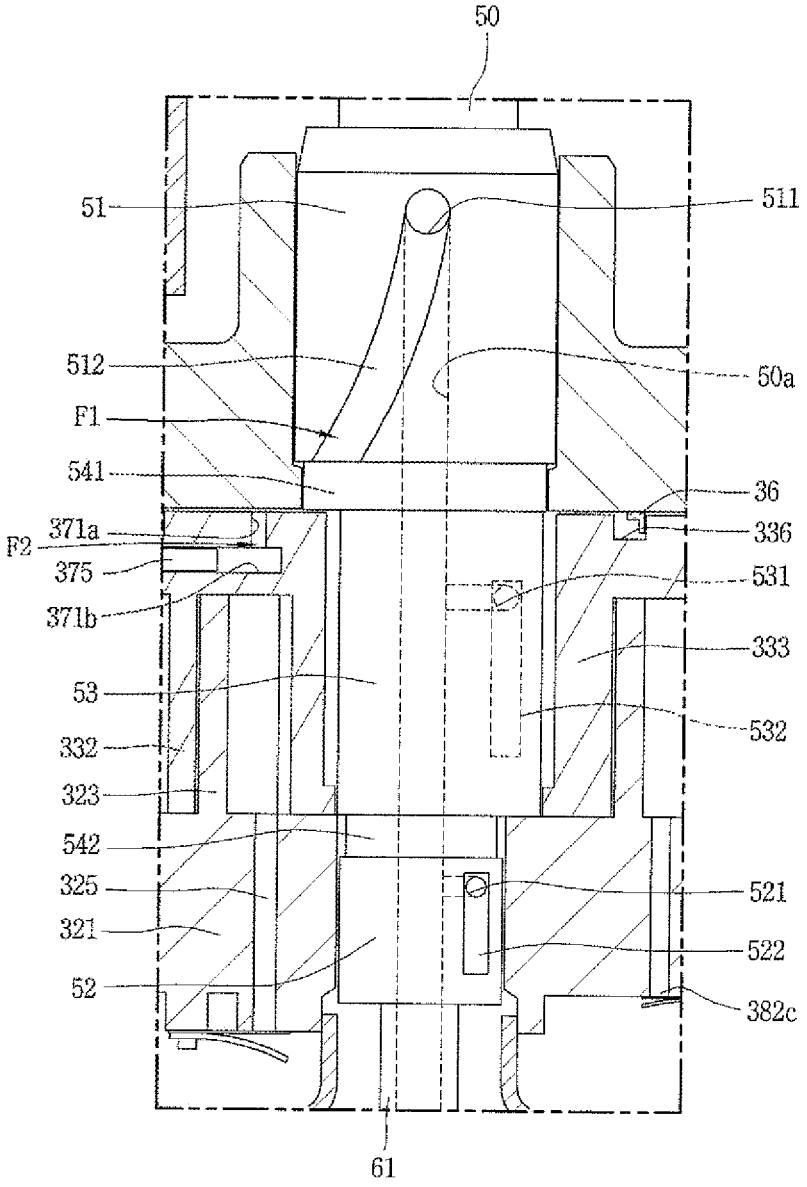
FIG. 3 is a front view illustrating a part of a rotating shaft for explaining a sliding portion in FIG. 1.
Figure 4:
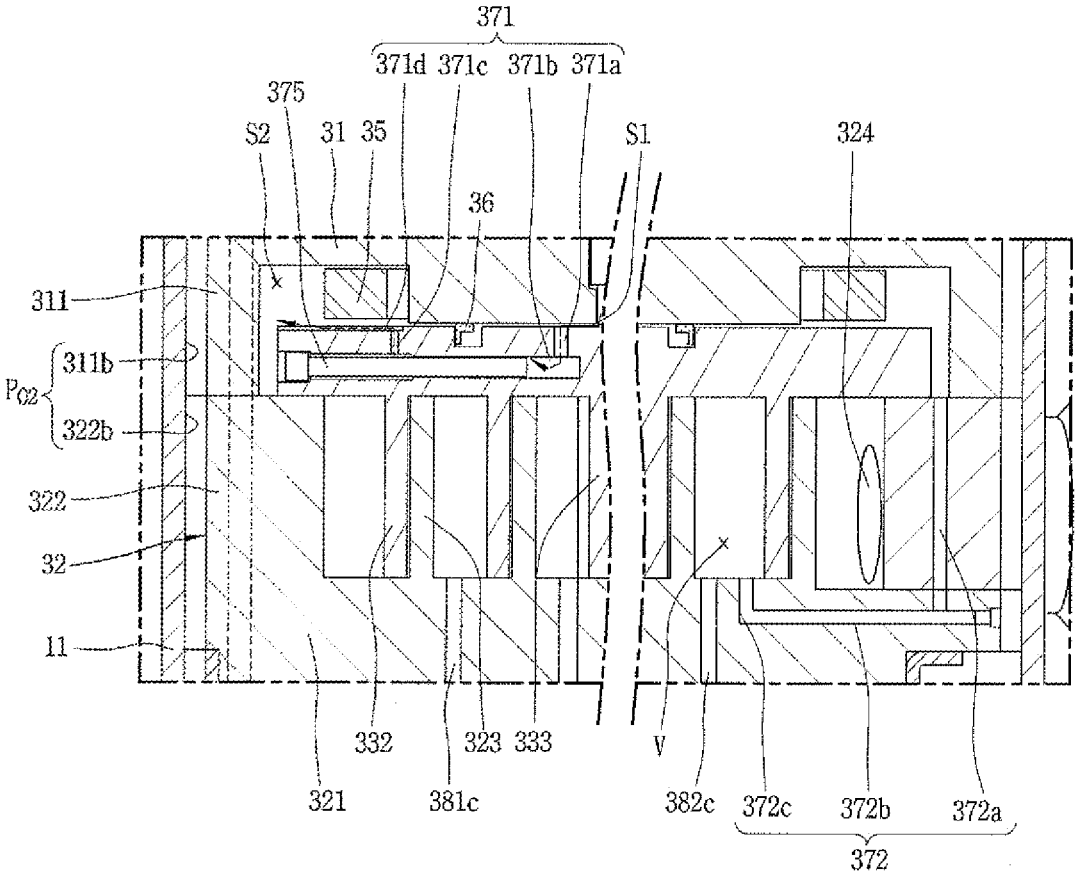
FIG. 4 is a longitudinal sectional view for explaining the oil supply passage between a back-pressure chamber and a compression chamber in FIG. 1.

FIG. 1 is a longitudinal sectional view illustrating a lower compression type scroll compressor according to the present disclosure, and FIG. 2 is a cross-sectional view illustrating a compression unit in FIG. 1, and FIG. 3 is a front view illustrating a part of a rotating shaft for explaining a sliding portion in FIG. 1, and FIG. 4 is a longitudinal sectional view for explaining the oil supply passage between a back pressure chamber and a compression chamber in FIG. 1.

Referring to FIG. 1, a lower compression type scroll compressor according to the present embodiment may be provided with a motor drive unit 20 having a drive motor within a casing 10 to generate a rotational force, and provided with a compression unit 30 having a predetermined space (hereinafter, referred to as an intermediate space) 10*a* below the motor drive unit 20 to receive rotational force of the motor drive unit 20 and compress refrigerant.

The casing 10 may include a cylindrical shell 11 constituting a sealed container, an upper shell 12 covering an upper portion of the cylindrical shell 11 to constitute a sealed container together, and a lower shell 13 covering a lower portion of the cylindrical shell 11 to constitute a sealed container together as well as forming an oil storage space 10*c*.

The refrigerant suction pipe 15 may pass through a lateral surface of the cylindrical shell 11 and directly communicate with a suction chamber of the compression unit 30, and a refrigerant discharge pipe 16 communicating with an upper space 10*b* of the casing 10 may be provided at an upper portion of the upper space 12. The refrigerant discharge pipe 16 may correspond to a passage through which compressed refrigerant discharged to the upper space 10*b* of the casing 10 from the compression unit 30 is discharged to the outside, and the refrigerant discharge pipe 16 may be inserted up to the middle of the upper space 10*b* of the casing 10 to allow the upper space 10*b* to form a kind of oil separation space. Furthermore, according to circumstances, an oil separator (not shown) for separating oil mixed with refrigerant may be connected to the refrigerant suction pipe 15 at an inside of the casing 10 or within the upper space 10*b* including the upper space 10*b*.

The motor drive unit 20 may include a stator 21 and a rotor 22 rotating at an inside of the stator 21. The stator 21 is formed with teeth and slots forming a plurality of coil winding portions (not shown) along a circumferential direction on an inner circumferential surface thereof, and a coil 25 is wound therearound, and a gap between an inner circumferential surface of the stator 21 and an outer circumferential surface of the rotor 22 and the coil winding portions are combined to form a second refrigerant passage (PG2). As a result, refrigerant discharged into the intermediate space 10*a* between the motor drive unit 20 and the compression unit 30 through the first refrigerant passage (PG1) which will be described later moves to the upper space 10*b* formed at an upper side of the motor drive unit 20 through the second refrigerant passage (PG2) formed in the motor drive unit 20.

Furthermore, a plurality of D-cut faces 21*a* are formed on an outer circumferential surface of the stator 21 along a circumferential direction, and D-cut face 21*a* may be formed with a first oil passage (PO1) to allow oil to pass between an inner circumferential surface of the cylindrical shell 11 and the D-cut face 21*a*. As a result, oil separated from refrigerant in the upper space 10*b* moves to the lower space 10*c* through the first oil passage (PO1) and the second oil passage (PO2) which will be described later.

A frame 31 constituting the compression unit 30 may be fixedly coupled to an inner circumferential surface of the casing 10 at a predetermined distance below the stator 21. The outer circumferential surface of the frame 31 may be shrink-fitted or welded and fixedly coupled to an inner circumferential surface of the cylindrical shell 11.

Furthermore, an annular frame sidewall portion (first sidewall portion) 311 is formed at an edge of the frame 31, and a plurality of communication grooves 311*b* are formed along a circumferential direction on an outer circumferential surface of the first sidewall portion 311. The communication groove 311*b* together with the communication groove 322*b* of the first scroll 32 which will be described later forms a second oil passage (PO2).

In addition, a first shaft receiving portion 312 for supporting a main bearing portion 51 of a rotating shaft 50 which will be described later is formed in the center of the frame 31, and a first shaft receiving hole 312*a* may be formed in an axial direction on the first shaft receiving portion such that the upper plate 51 of the 50 of the rotating shaft 50 is rotatably inserted and supported in a radial direction.

Furthermore, a fixed scroll (hereinafter, referred to as a first scroll) 32 may be provided on a lower surface of the frame 31 with an orbiting scroll (hereinafter, referred to as a second scroll) 33 eccentrically connected to the rotating shaft 50 interposed therebetween. The first scroll 32 may be fixedly coupled to the frame 31, but may also be movably coupled in an axial direction.

On the other hand, the first scroll 32 has a fixed plate portion (hereinafter, referred to as a first plate portion 321) formed in a substantially disc shape, and a scroll sidewall portion (hereinafter, referred to as a second sidewall portion) 322 coupled to a lower edge of the frame 31 may be formed at an edge of the first plate portion 321.

A suction port 324 through which the refrigerant suction pipe 15 communicates with the suction chamber may be formed in one side of the second sidewall portion 322, and a discharge port 325*a*, 325*b* communicating with a discharge chamber to discharge compressed refrigerant may be formed at a central portion of the first plate portion 321. Only one of the discharge ports 325*a*, 325*b* may be formed to communicate with both a first compression chamber (V1) and a second compression chamber (V2) which will be described later, but a plurality of discharge ports 325*a*, 325*b* may be also formed to independently communicate with compression chambers (V1, V2), respectively.

In addition, the foregoing communication groove 322*b* is formed on an outer circumferential surface of the second sidewall portion 322, and the communication groove 322*b* together with the communication groove 311*b* of the first sidewall portion 311 forms a second oil passage (PO2) for guiding oil to the lower space 10*c*.

Furthermore, a discharge cover 34 for guiding refrigerant discharged from the compression chamber (V) to a refrigerant passage which will be described later may be coupled to a lower side of the first scroll 32. An inner space of the discharge cover 34 may be formed to receive an inlet of the first refrigerant passage (PG1) for guiding refrigerant discharged from the compression chamber (V) through the discharge port 325*a*, 325*b* to an upper space 10*b* of the casing 10, more particularly, a space between the motor drive unit 20 and the compression unit 30 while at the same receiving the discharge port 325*a*, 325*b*.

Here, the first refrigerant passage (PG1) may be formed to sequentially pass through the second sidewall portion 322 of the fixed scroll 32 and the first sidewall portion 311 of the frame 31 from an inside of the passage separation unit 40, namely, the side of the rotating shaft 50, which is an inside based on the passage separation unit 40. As a result, the foregoing second oil passage (PO2) is formed at an outside of the passage separation unit 40 to communicate with the first oil passage (PO1).

Furthermore, a fixed wrap (hereinafter, referred to as a first wrap) 323 constituting the compression chamber (V) in engagement with an orbiting wrap (hereinafter, referred to as a second wrap) which will be described later may be formed on an upper surface of the first plate portion 321. The first wrap 323 will be described later together with the second wrap 332.

In addition, a second shaft receiving portion 326 for supporting a sub-bearing portion 52 of the rotating shaft 50 which will be described later may be formed at the center of the first plate portion 321, and a second bearing hole 326*a* penetrated in an axial direction to support the sub-bearing portion 52 in a radial direction may be formed on the second shaft receiving portion 326.

On the other hand, for the second scroll 33, an orbiting plate portion (hereinafter, referred to as second plate portion) 331 may be formed in a substantially disc shape. A second wrap 332 constituting a compression chamber in engagement with the first wrap 331 may be formed on a lower surface of the second plate portion 331.

The second wrap 332 may be formed in an involute shape together with the first wrap 323, but may be formed in various other shapes. For example, as illustrated in FIG. 2, the second wrap 332 may have a shape in which a plurality of arcs having different diameters and origin points are connected, and the outermost curve may be formed in a substantially elliptical shape having a long axis and a short axis. The first wrap 323 may be formed in a similar manner.

A rotating shaft coupling portion 333 constituting an inner end portion of second wrap 332 to which the eccentric portion 53 of the rotating shaft 50 which will be described later is inserted and coupled may be formed in a penetrating manner in an axial direction.

An outer circumferential portion of the rotating shaft coupling portion 333 is connected to the second wrap 332 to form the compression chamber (V) together with the first wrap 322 during the compression process.

Furthermore, the rotating shaft coupling portion 333 may be formed at a height overlapping with the second wrap 332 on the same plane, and the eccentric portion 53 of the rotating shaft 50 may be formed at a height overlapping with the second wraps 332 on the same plane. Through this, a repulsive force and a compressive force of refrigerant are canceled each other while being applied to the same based on the second plate portion, thereby preventing the inclination of the second scroll 33 due to an action of the compressive force and repulsive force.

In addition, the rotating shaft coupling portion 333 is formed with a concave portion 335 engaged with a protrusion portion 328 of the first wrap 323 which will be described later at an outer circumferential portion opposed to an inner end portion of the first wrap 323. One side of the concave portion 335 is formed with an increasing portion 335*a* configured to increase a thickness thereof from an inner circumferential portion to an outer circumferential portion of the rotating shaft coupling portion 333 at an upstream side along the formation direction of the compression chamber (V). It may increase a compression path of the first compression chamber (V1) immediately before discharge, and consequently a compression ratio of the first compression chamber (V1) may be increased close to a pressure ratio of the second compression chamber (V2). The first compression chamber (V1) is a compression chamber formed between an inner surface of the first wrap 323 and an outer surface of the second wrap 332, and will be described later separately from the second compression chamber (V2).

The other side of the concave portion 335 is formed with an arc compression surface 335*b* having an arc shape. A diameter of the arc compression surface 335*b* is determined by a thickness of an inner end portion of the first wrap 323 (i.e., a thickness of the discharge end) and an orbiting radius of the second wrap 332, and when a thickness of an inner end portion of the first wrap 323 increases, a diameter of the arc compression surface 335*b* increases. As a result, a thickness of the second wrap around the arc compression surface 335*b* may be increased to ensure durability, and the compression path may be lengthened to increase a compression ratio of the second compression chamber (V2) to that extent.

In addition, a protrusion portion 328 protruded to the side of an outer circumferential portion of the rotating shaft coupling portion 333 may be formed adjacent to an inner end portion (suction end or starting end) of the first wrap 323 corresponding to the rotation shaft coupling portion 333, the protrusion portion 328 may be formed with a contact portion 328*a* protruded from the protrusion portion and engaged with the concave portion 335. In other words, an inner end portion of the first wrap 323 may be formed to have a larger thickness than other portions. As a result, a wrap strength at an inner end portion thereof, which is subjected to the highest compressive force on the first wrap 323, may be enhanced to enhance durability.

On the other hand, the compression chamber (V) is formed between the first plate portion 321 and the first wrap 323, and between the second wrap 332 and the second plate portion 331, and a suction chamber, an intermediate pressure chamber, and a discharge chamber may be sequentially formed along the proceeding direction of the wrap.

As illustrated in FIG. 2, the compression chamber (V) may include a first compression chamber (V1) formed between an inner surface of the first wrap 323 and an outer surface of the second wrap 332, and a second compression chamber (V2) formed between an outer surface and an inner surface of the second wrap 332.

In other words, the first compression chamber (V1) includes a compression chamber formed between two contact points (P11, P12) generated by bringing an inner surface of the first wrap 323 into contact with an outer surface of the second wrap 332, and the second compression chamber (V2) includes a compression chamber formed between two contact points (P21, P22) formed by bringing an outer surface of the first wrap 323 into contact with an inner surface of the second wrap 332.

Here, when an angle having a large value between angles formed by the center of the eccentric portion, namely, the center (O) of the rotating shaft coupling portion, and two lines connecting the two contact points (P11, P12), respectively, is defined as a, the first compression chamber (V1) immediately before discharge has an angle of $\alpha<360°$ immediately before starting discharge, and a distance (l) between normal vectors at the two contact points (P11, P12) also has a value larger than zero.

As a result, the first compression chamber immediately before discharge may have a smaller volume as compared to a case where the first compression chamber has a fixed wrap and an orbiting wrap formed with an involute curve, it may be possible to enhance both a compression ratio of the first compression chamber (V1) and a compression ratio of the second compression chamber (V2) without increasing a size of the first wrap 323 and the second wrap 332.

On the other hand, as described above, the second scroll 33 may be orbitally provided between the frame 31 and the fixed scroll 32. An oldham ring 35 for preventing the rotation of the second scroll 33 may be provided between an upper surface of the second scroll 33 and a lower surface of the frame 31, and a sealing member 36 for forming a back pressure chamber (S1) may be provided at an inner side than the oldham ring 35.

Furthermore, an intermediate pressure space is formed by the oil supply hole 321*a* provided in the second scroll 32 at an outer side of the sealing member 36. The intermediate pressure space is communicated with the intermediate compression chamber (V) to perform the role of a back pressure chamber as refrigerant at an intermediate pressure is filled thereinto. Therefore, a back pressure chamber formed at an inner side with respect to the sealing member 36 may be referred to as a first back pressure chamber (S1), and an intermediate pressure space formed at an outside may be referred to as a second back pressure chamber (S2). As a result, the back pressure chamber (S1) is a space formed by a lower surface of the frame 31 and a upper surface of the second scroll 33 around the sealing member 36, and the back pressure chamber (S1) will be described again along with the sealing member which will be described later.

On the other hand, the passage separation unit 40 is provided in the intermediate space 10*a*, which is a via space formed between a lower surface of the motor drive unit 20 and an upper surface of the compression unit 30, to perform the role of preventing refrigerant discharged from the compression unit 30 from interfering with oil moving from the upper space 10*b* of the motor drive unit 20 which is an oil separation space to the lower space 10*c* of the compression unit 30 which is an oil storage space.

To this end, the passage separation unit 40 according to the present embodiment includes a passage guide for separating the first space 10*a* into a space through which refrigerant flows (hereinafter, referred to as a refrigerant flow space) and a space through which oil flows (hereinafter, referred to as an oil flow space). The passage guide may separate the first space 10*a* into the refrigerant flow space and the oil flow space by the passage guide itself, but according to circumstances, a plurality of passage guides may be combined to perform the role of a passage guide.

The passage separation unit according to the present embodiment includes a first passage guide 410 provided in the frame 31 and extended upward and a second passage guide 420 provided in the stator 21 and extended downward. The first passage guide 410 and the second passage guide 420 may be overlapped in an axial direction to divide the intermediate space 10*a* into the refrigerant flow space and the oil flow space.

Here, the first passage guide 410 may be formed in an annular shape and fixedly coupled to an upper surface of the frame 31, and the second passage guide 420 may be inserted into the stator 21 and extended from an insulator for insulating winding coils.

The first passage guide 410 includes a first annular wall portion 411 extended upward from the outside, a second annular wall portion 412 extended upward from the inside, and an annular surface portion 413 extended in a radial direction to connect between the first annular wall portion 411 and the second annular wall portion 412. The first annular wall portion 411 may be formed higher than the second annular wall portion 412, and a coolant through hole may be formed on the annular surface portion 413 to allow a coolant hole communicated from the compression unit 30 to the intermediate space 10*a* to communicate therewith.

Furthermore, a balance weight 26 is located at an inside of the second annular wall portion 412, namely, in a rotational shaft direction, and the balance weight 26 is engaged with the rotor 22 or the rotating shaft 50 to rotate. At this time, refrigerant may be stirred while the balance weight 26 rotates, but the refrigerant may be prevented from moving toward the balance weight 26 by the second annular wall portion 412 to suppress the refrigerant from being stirred by the balance weight.

The second flow guide 420 may include a first extension portion 421 extended downward from an outside of the insulator and a second extension portion 422 extended downward from an inside of the insulator. The first extension portion 421 is formed to overlap with the first annular wall portion 411 in an axial direction to perform the role of dividing a space into the refrigerant flow space and the oil flow space. The second extension portion 422 may be not formed as necessary, but may preferably be formed not to overlap with the second annular wall portion 412 in an axial direction or formed at a sufficient distance in a radial direction to sufficiently flow refrigerant even if it does not overlap therewith.

On the other hand, an upper portion of the rotating shaft 50 is press-fitted and coupled to the center of the rotor 22 while a lower portion thereof is coupled to the compression unit 30 to be supported in a radial direction. As a result, the rotating shaft 50 transfers a rotational force of the motor drive unit 20 to the orbiting scroll 33 of the compression unit 30. Then, the second scroll 33 eccentrically coupled to the rotating shaft 50 performs an orbiting movement with respect to the first scroll 32.

A main bearing portion (hereinafter, referred to as a first bearing portion) 51 may be formed at a lower half portion of the rotating shaft 50 to be inserted into the first shaft receiving hole 312*a* of the frame 31 and supported in a radial direction, and a sub-bearing portion (hereinafter, referred to as a second bearing portion) 52 may be formed at a lower side of the first bearing portion 51 to be inserted into the second shaft receiving hole 326*a* of the first scroll 32 and supported in a radial direction. Furthermore, the eccentric portion 53 may be formed between the first bearing portion 51 and the second bearing portion 52 to be inserted into the rotating shaft coupling portion 333 and coupled thereto.

The first bearing portion 51 and the second bearing portion 52 may be coaxially formed to have the same axial center, and the eccentric portion 53 may be eccentrically formed in a radial direction with respect to the first bearing portion 51 or the second bearing portion 52. The second bearing portion 52 may be eccentrically formed with respect to the first bearing portion 51.

The eccentric portion 53 should be formed in such a manner that its outer diameter is smaller than an outer diameter of the first bearing portion 51 and larger than an outer diameter of the second bearing portion 52 to be advantageous in coupling the rotating shaft 50 to the respective shaft receiving holes 312*a*, 326*a* through the rotating shaft coupling portion 333. However, in case where the eccentric portion 53 is formed using a separate bearing without being integrally formed with the rotating shaft 50, the rotation shaft 50 may be inserted and coupled thereto even when an outer diameter of the second bearing portion 52 is not formed to be smaller than an outer diameter of the eccentric portion 53.

Furthermore, an oil supply passage 50*a* for supplying oil to each bearing portion and the eccentric portion may be formed along an axial direction within the rotating shaft 50. The oil supply passage 50*a* may be formed from a lower end of the rotating shaft 50 to substantially a lower end or a middle height of the stator 21 or a position higher than an upper end of the first bearing portion 31 by grooving as the compression unit 30 is located below the motor drive unit 20. Of course, according to circumstance, it may be formed by penetrating the rotating shaft 50 in an axial direction.

In addition, an oil feeder 60 for pumping oil filled in the lower space 10*c* may be coupled to a lower end of the rotating shaft 50, namely, a lower end of the second bearing portion 52. The oil feeder 60 may include an oil supply pipe 61 inserted and coupled to the oil supply passage 50*a* of the rotating shaft 50 and a blocking member 62 for receiving the oil supply pipe 61 to block the intrusion of foreign matter. The oil supply pipe 61 may be located to pass through the discharge cover 34 and immerse in the oil of the lower space 10*c*.

On the other hand, as illustrated in FIG. 3, a sliding portion oil supply passage (F1) connected to the oil supply passage 50*a* to supply oil to each sliding portion is formed on each bearing portion 51, 52 and the eccentric portion 53 of the rotating shaft 50.

The sliding portion oil supply passage (F1) includes a plurality of oil supply holes 511, 521, 531 penetrated from the oil supply passage 50*a* toward an outer circumferential surface of the rotating shaft 50, and a plurality of oil supply grooves 512, 522, 532 communicated with the oil supply holes 511, 521, 531, respectively, to lubricate each bearing portions 51, 52 and the eccentric portion 53.

For example, a first oil supply hole 511 and a first oil supply groove 512 are formed in the first bearing portion 51, and a second oil supply hole 521 and a second oil supply groove 522 are formed in the second bearing portion 52, and a third oil supply hole 531 and a third oil supply groove 532 are formed in the eccentric portion 53, respectively. The first oil supply groove 512, the second oil supply groove 522, and the third oil supply groove 532 are respectively formed in an elongated manner in an axial or oblique direction.

Furthermore, a first connection groove 541 and a second connection groove 541 formed in an annular shape, respectively, may be formed between the first bearing portion 51 and the eccentric portion 53 and between the eccentric portion 53 and the second bearing portion 52, respectively. A lower end of the first oil supply groove 512 is communicated with the first connection groove 541, and an upper end of the second oil supply groove 522 is connected to the second connection groove 542. Accordingly, a part of oil that lubricates the first bearing portion 51 through the first oil supply groove 512 flows down to be collected into the first connection groove 541, and this oil flows into the first back pressure chamber (S1) to form a back pressure of the discharge pressure. The oil that lubricates the second bearing portion 52 through the second oil supply groove 522 and the oil that lubricates the eccentric portion 53 through the third oil supply groove 532 are collected into the second connection groove 542, and introduced into the compression unit 30 through a space between a front end surface of the rotating shaft coupling portion 333 and the first plate section 321.

In addition, a small amount of oil sucked up in an upper direction of the first bearing portion 51 flows out of a bearing surface thereof at an upper end of the first shaft receiving portion 312 of the frame 31 and flows down to an upper surface 31*a* of the frame 31 along the first shaft receiving portion 312, and then is collected to the lower space 10*c* through the oil passages (PO1, PO2) successively formed on an outer circumferential surface of the frame 31 (or a groove communicated from the upper surface to the outer circumferential surface) and an outer circumferential surface of the first scroll 32.

Moreover, oil discharged from the compression chamber (V) to the upper space 10*b* of the casing 10 together with refrigerant is separated from refrigerant in the upper space 10*b* of the casing 10 and collected into the lower space 10*c* through the first oil passage (PO1) formed on an outer circumferential surface of the motor drive unit 20 and the second oil passage (PO2) formed on an outer circumferential surface of the compression unit 30. At this time, a passage separation unit 40 is provided between the drive unit 20 and the compression unit 30 to allow oil to move to the lower space 10*c* and allow refrigerant to move to the upper space 10*b*, respectively, through different passages (PO1, PO2) (PG1, PG2) in such a manner that oil separated from refrigerant in the upper space 10*b* and moved to the lower space 10*c* is not interfered and remixed with refrigerant discharged from the compression unit 20 and moved to the upper space 10*b*.

On the other hand, the second scroll 33 is formed with a compression chamber oil supply passage (F2) for supplying oil sucked up through the oil supply passage 50*a* to the compression chamber (V). The compression chamber oil supply passage (F2) is connected to the above-described sliding portion oil supply passage (F1).

The compression chamber oil supply passage (F2) may include a first oil supply passage 371 communicating between the oil supply passage 50*a* and the second back pressure chamber (S2) constituting an intermediate pressure space, and a second oil supply passage 372 communicating with the intermediate pressure chamber of the compression chamber (V).

Of course, the compression chamber oil supply passage may be formed to communicate directly from the oil supply passage 50*a* to the intermediate pressure chamber without passing through the second back pressure chamber (S2). In this case, however, a refrigerant passage for communicating the second back pressure chamber (S2) with the intermediate pressure chamber (V) should be separately provided, and an oil passage for supplying oil to the oldham ring 35 located in the second back pressure chamber (S2) should be separately provided. Due to this, a number of passages may increase to complicate processing. Therefore, in order to reduce a number of passages by unifying the refrigerant passage and the oil passage into one, as described in the present embodiment, it may be preferable that the oil supply passage 50*a* is communicated with the second back pressure chamber (S2) and the second back pressure chamber (S2) is communicated with the intermediate pressure chamber (V).

To this end, the first oil supply passage 371 is formed with a first orbiting passage portion 371*a* formed from a lower surface of the second plate portion 331 to the middle in a thickness direction, and a second orbiting passage portion 371*b* is formed from the first orbiting passage portion 371*a* to an outer circumferential surface of the second plate portion 331, and a third orbiting passage portion 371*c* penetrated from the second orbiting passage portion 371*b* to an upper surface of the second plate portion 331.

Furthermore, the first orbital passage portion 371*a* is formed at a position belonging to the first back pressure chamber (S1), and the third orbital passage portion 371*c* is formed at a position belonging to the second back pressure chamber (S2). Furthermore, a pressure reducing rod 375 is inserted into the second orbital passage portion 371*b* to reduce a pressure of oil moving from the first back pressure chamber (S1) to the second back pressure chamber (S2) through the first oil supply passage 371. As a result, a cross-sectional area of the second orbital passage portion 371*b* excluding the pressure reducing rod 375 is formed to be smaller than that of the first orbital passage portion 371*a* or the third orbital passage portion 371*c*.

Here, in case where an end portion of the third orbital passage portion 371*c* is formed to be located at an inside of the oldham ring 35, namely, between the oldham ring 35 and the sealing member 36, oil moving through the first oil supply passage 371 may be blocked by the oldham ring 35 and thus not be efficiently moved to the second back pressure chamber (S2). Therefore, in this case, a fourth orbital passage portion 371*d* may be formed from an end portion of the third orbital passage portion 371*c* toward an outer circumferential surface of the second plate portion 331. The fourth orbital passage portion 371*d* may be formed as a groove on an upper surface of the second plate portion 331 or may be formed as a hole within the second plate portion 331 as illustrated in FIG. 4.

The second oil supply passage 372 is formed with a first fixed passage portion 372*a* in a thickness direction on an upper surface of the second sidewall portion 322, and formed with a second fixed passage portion 372*b* in a radial direction from the first fixed passage portion 372*a*, and formed with a third fixed passage portion 372*c* communicating from the second fixed passage portion 372*b* to the intermediate pressure chamber (V).

On the drawing, reference numeral 70 is an accumulator.

A lower compression type scroll compressor according to the present embodiment operates as follows.

In other words, when power is applied to the motor drive unit 20, a rotational force is generated to the rotor 21 and the rotating shaft 50 to rotate, and as the rotating shaft 50 rotates, the orbiting scroll 33 eccentrically coupled to the rotating shaft 50 is orbitally moved by the oldham ring 35.

Then, refrigerant supplied from an outside of the casing 10 through the refrigerant suction pipe 15 is introduced into the compression chamber (V), and compressed and discharged to an inner space of the discharge cover 34 through the discharge port 325*a*, 325*b* as a volume of the compression chamber (V) is reduced by the orbiting movement of the orbiting scroll 33.

Then, refrigerant discharged to the inner space of the discharge cover 34 is circulated into an inner space of the discharge cover 34 and moved to a space between the frame 31 and the stator 21 after noise is reduced, and the refrigerant is moved to an upper space of the motor drive unit 20 through a gap between the stator 21 and the rotor 22.

Then, a series of processes in which oil is separated from refrigerant in an upper space of the motor drive unit 20, and then the refrigerant is discharged to an outside of the casing 10 through the refrigerant discharge pipe 16 while the oil is collected into the lower space 10*c* which is an oil storage space of the casing 10 through a passage between an inner circumferential surface of the casing 10 and the stator 21 and a passage between an inner circumferential surface of the casing 10 and an outer circumferential surface of the compression unit 30 are repeated.

At this time, oil in the lower space 10*c* is sucked up through the oil supply passage 50*a* of the rotating shaft 50, and the oil lubricates the first bearing portion 51, the second bearing portion 52, and the eccentric portion 53, respectively, through the oil supply holes 511, 521, 531 and the oil supply grooves 512, 522, 532, respectively.

Among them, oil that lubricates the first bearing portion 51 through the first oil supply hole 511 and the first oil supply groove 512 is collected into the first connection groove 51 between the first bearing portion 51 and the eccentric portion 53, and this oil flows into the first back pressure chamber (S1). This oil forms a substantial discharge pressure, and a pressure of the first back pressure chamber (S1) also forms a substantial discharge pressure. Therefore, the center portion side of the second scroll 33 may be supported in an axial direction by the discharge pressure.

On the other hand, the oil of the first back pressure chamber (S1) is moved to the second back pressure chamber (S2) through the first oil supply passage 371 by a pressure difference from the second back pressure chamber (S2). At this time, a pressure reducing rod 375 is provided in the second orbiting passage portion 371*b* constituting the first oil supply passage 371, and thus an oil pressure toward the second back pressure chamber (S2) is reduced to an intermediate pressure.

In addition, oil moving to the second back pressure chamber (intermediate pressure space) (S2) supports an edge portion of the second scroll 33 while at the same time moving to the intermediate pressure chamber (V) through the second oil supply passage 372 according to a pressure difference from the intermediate pressure chamber (V). However, when a pressure of the intermediate pressure chamber (V) becomes higher than that of the second back pressure chamber (S2) during the operation of the compressor, refrigerant moves from the intermediate pressure chamber (V) to the second back pressure chamber (S2) through the second oil supply passage 372. In other words, the second oil supply passage 372 performs the role of a passage through which the refrigerant and the oil alternatively move according to a difference between a pressure of the second back pressure chamber (S2) and a pressure of the intermediate pressure chamber (V).

On the other hand, in most scroll compressors including the above-described axial through scroll compressor, not only gas refrigerant but also liquid refrigerant may be sucked together during the process of sucking refrigerant into the compression chamber, and thus over-compression loss may occur while being compressed. Accordingly, the scroll compressor may form bypass holes in the middle of each compression chamber to bypass liquid refrigerant in advance or bypass a part of gas refrigerant to be compressed, thereby preventing the over compression from occurring.

However, as described above, in the axial through scroll compressor, as a discharge port is formed at a position eccentric from the center of the orbiting scroll, compression path lengths of both compression chambers are different. In other words, a compression path of the first compression chamber is formed to be relatively larger than that of the second compression chamber. Accordingly, in the second compression chamber having a relatively smaller compression path, a flow rate of refrigerant may increase, thereby generating larger over compression than in the first compression chamber. Nevertheless, according to the related art, the sizes and positions of bypass holes formed in the first compression chamber and the second compression chamber, respectively, are symmetrically formed, and thus there is a limitation in effectively reducing over-compression loss.

In view of this, according to the present disclosure, the sizes and positions of bypass holes formed in the first compression chamber and the second compression chamber may be formed differently according to a compression gradient of each compression chamber to effectively reduce over-compression loss in a compression chamber having a larger compression gradient, thereby enhancing the efficiency of the compressor.

It will be described in detail with reference to FIGS. 5 through 10. First, FIG. 5 is a schematic view illustrating a volume diagram for a first compression chamber and a second compression chamber in a typical axial through scroll compressor.

Figure 5:
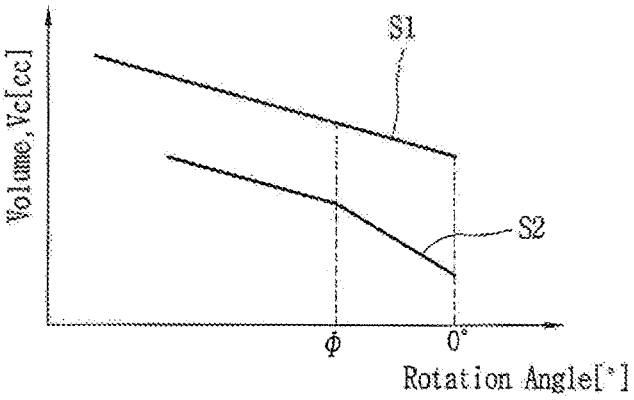
FIG. 5 is a schematic view illustrating a volume diagram for a first compression chamber and a second compression chamber in a typical axial through scroll compressor.

As illustrated in FIG. 5, it is illustrated that a volume of the first compression chamber (V1) is gradually reduced from a compression start angle to a discharge complete angle, whereas a volume of the second compression chamber (V2) is gradually reduced from a compression start angle to an approximate discharge start time similarly to a gradient of the first compression chamber (V1), but drastically reduced with a larger gradient than that of the first compression chamber (V1) from the an approximate discharge start angle to the discharge complete angle.

It may be seen that a volume of the second compression chamber (V2) is smaller than that of the first compression chamber (V1) but reduced with a larger gradient from the vicinity of the approximate discharge start angle. Accordingly, it may be seen that a pressure inversely proportional to a volume may be drastically increased in the second compression chamber (V2) as compared to the first compression chamber (V1), and larger over-compression loss may occur in the second compression chamber (V2) as compared to the first compression chamber (V1).

Therefore, according to the present embodiment, at least one (more exactly, a plurality of) bypass holes may be formed along the respective paths of the first compression chamber (V1) and the second compression chamber (V2), and an overall cross-sectional area of bypass holes (hereinafter, referred to as second bypass holes) belonging to the second compression chamber (V2) may be formed to be larger than that of bypass holes (hereinafter, referred to as first bypass holes) belonging to the first compression chamber (V1) in a range from a specific angle (Φ) at which the foregoing discharge start angle or volume is drastically reduced to increase the compression gradient up to a discharge complete angle. For this purpose, an inner diameter of the bypass hole belonging to the second compression chamber (V2) may be formed to be larger or a number of the bypass hole may be increased as compared to that of the bypass hole belonging to the first compression chamber (V1).

Of course, the first bypass hole and the second bypass hole may be formed in substantially the same size at substantially the same angle (or number) along the respective compression paths of the first compression chamber (V1) and the second compression chamber (V2) from a suction complete angle to the foregoing specific angle (Φ).

However, since a compression path of the second compression chamber (V2) is smaller than that of the first compression chamber (V1), a second bypass hole (it may be referred to as a "group" or "bypass portion") of the second compression chamber (V2) may be located subsequent to the foregoing specific angle (Φ) with respect to a suction end which is an outer end of the first wrap. In this case, the second bypass hole may be formed to have a larger cross-sectional area than the first bypass hole in a range from the specific angle (Φ) to the discharge complete angle.

In other words, as a whole, an overall cross-sectional area of the first bypass hole and an overall cross-sectional area of the second bypass hole are formed to be the same, but as described above, the overall cross-sectional area of the first bypass hole is formed larger than that of the second bypass hole in a range from the suction complete angle to the specific angle (Φ). Accordingly, in a range from the specific angle (Φ) to the discharge complete angle, an overall cross-sectional area of the second bypass hole may be formed to be larger than that of the first bypass hole in an opposite manner to the range described above.

Figure 6:
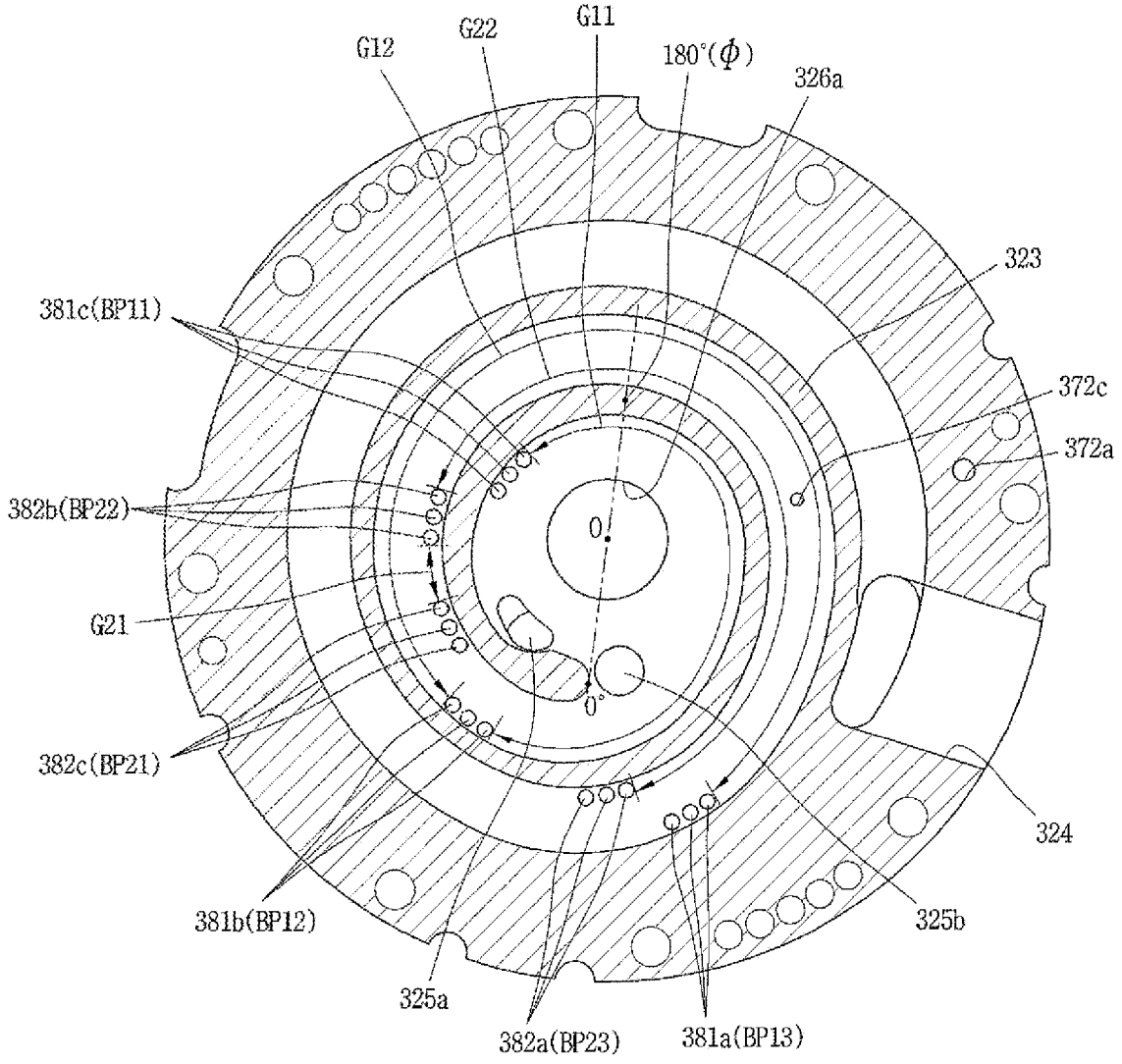
FIG. 6 is a plan view illustrating an embodiment of a first scroll to which bypass holes according to the present embodiment are applied.

FIG. 6 is a plan view illustrating an embodiment of a first scroll to which the bypass hole according to the present embodiment is applied. As illustrated in the drawing, for example, bypass holes may be formed at three points at intervals of an arbitrary rotation angle along the compression path of each of the compression chambers (V1, V2), and three holes 381*a*, 381*b*, 381*c*, 382*a*, 382*b*, 382*c* may be formed at each point, and thus total nine bypass holes may be formed in the first compression chamber (V1) and the second compression chamber (V2), respectively.

Here, three bypass holes 381*a*, 381*b*, 381*c* formed at each point may be referred to as a bypass hole group, and when bypass holes groups located away from a bypass hole group close to each discharge port 325*a*, 325*b* around the each discharge port 325*a*, 325*b* are referred to as a first group (BP11) of the first compression chamber, a first group (BP21) of the second compression chamber, a second group (BP12) of the first compression chamber and a second group (BP22) of the second compression chamber, and a third group (BP13) of the first compression chamber and a third group (BP23) of the second compression chamber, respectively, and a rotation angular interval between the first groups (BP11, BP21) and the second groups (BP12, BP22) is defined as a first inner interval (G11) and a first outer interval (G21) and a rotation angular interval between the second groups (BP12, BP22) and the third groups (BP13, BP23) is defined as a second inner interval (G12) and a second outer interval (G22), the first outside interval (G21) in the second compression chamber (V2) may be formed to be significantly smaller than the first inside interval (G11) in the first compression chamber (V1).

Accordingly, in case of the first bypass holes 381*a*, 381*b*, 381*c*, only the first group (BP11) may correspond to bypass holes for discharge, and the second group (BP12) and the third group (BP13) may correspond to bypass holes for discharging liquid refrigerant. On the contrary, in case of the second bypass holes 382*a*, 382*b*, 382*c*, the first group (BP21) and the second group (BP22) may correspond to bypass holes for discharge, and only the third group (BP23) may correspond to the bypass holes for discharging liquid refrigerant.

Through this, an overall cross-sectional area of the second bypass hole (or the second bypass hole group) may be formed to be larger in a range from the foregoing specific angle (Φ) to the discharge complete angle (0°), thereby effectively reducing over-compression loss occurring in a relatively large scale in the second compression chamber (V2).

Figure 7A:
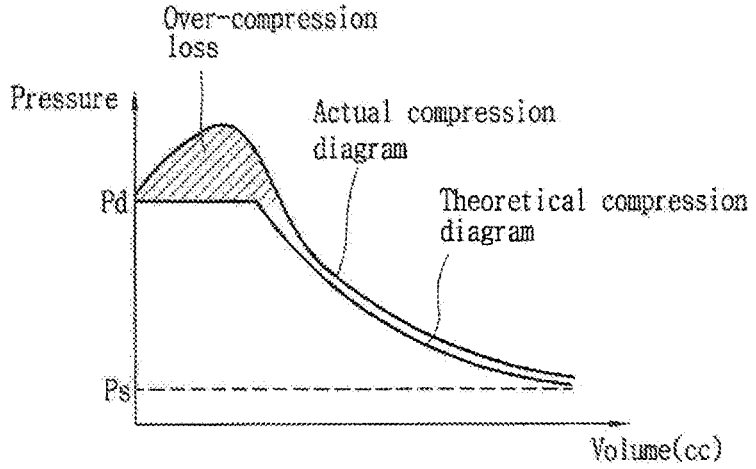
FIGS. 7A and 7B are compression diagrams in which a pressure change for a second compression chamber in a lower compression scroll compressor provided with bypass holes illustrated in FIG. 6 is compared with the related art.
Figure 7B:
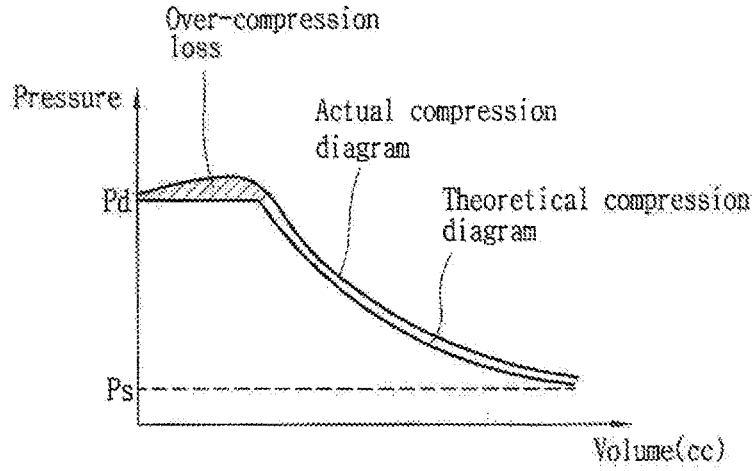

FIGS. 7A and 7B are compression diagrams in which a pressure change for the second compression chamber in a lower compression scroll compressor provided with a bypass hole illustrated in FIG. 6 is compared with the related art, wherein FIG. 7A and FIG. 7B illustrate the related art and the present embodiment, respectively.

As illustrated in FIG. 7A, according to an actual compression diagram for the second compression chamber (V2) in the related art, it is seen that so-called over-compression loss, which is compressed at a pressure above the discharge pressure (Pd) as compared with a theoretical compression diagram, significantly occurs.

However, when a space between bypass holes for discharge located on the discharge side is formed narrowly as in the present embodiment illustrated in FIG. 6, over-compression loss in the second compression chamber (V2) may be significantly reduced as illustrated in FIG. 7B while over-compressed refrigerant is bypassed in a short period of time.

In this manner, an overall cross-sectional area of the second bypass hole belonging to the second compression chamber (V2) having a large compression gradient between the first compression chamber (V1) and the second compression chamber (V2) may be formed to be larger that of the first bypass hole belonging to the first compression chamber (V1) having a smaller compression gradient, thereby preventing over compression in the second compression chamber (V2) to enhance the overall efficiency of the compressor.

Meanwhile, another embodiment of a bypass hole in a scroll compressor according to the present disclosure is as follows. In other words, according to the present embodiment, bypass holes may be formed in the same manner as in the above-described embodiment, but a size or number of bypass holes may be formed differently, thereby effectively reducing the over-compression loss for the second compression chamber having a large compression gradient. FIGS. 8 through 11 are views illustrating those embodiments.

Figure 8:
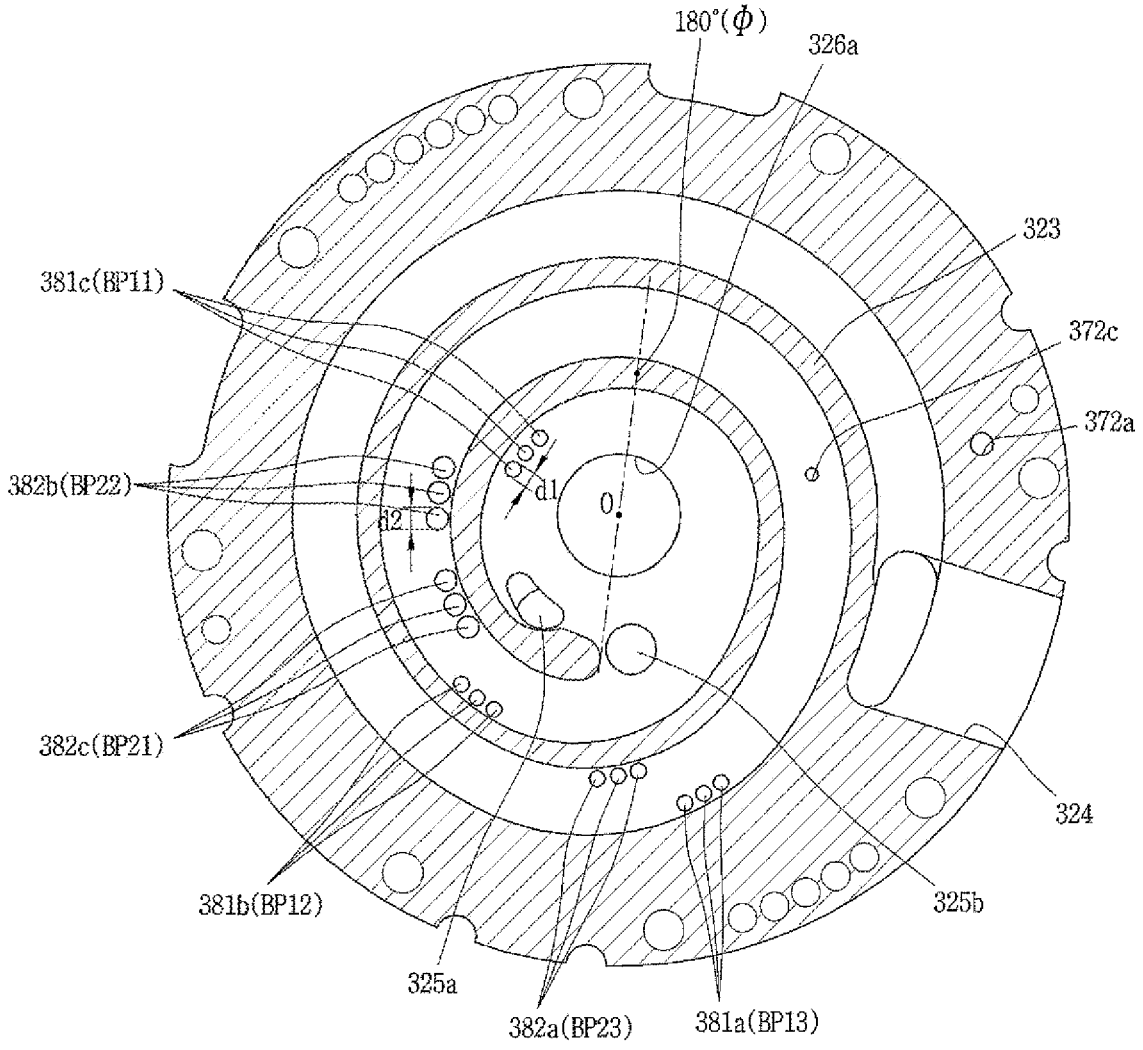
FIGS. 8 through 10 are views illustrating other embodiments in which bypass holes are formed in the same manner as in the foregoing embodiment, but a size or number of bypass holes may be formed in a different manner.

For example, as illustrated in FIG. 8, a size (d2) of each second bypass hole belonging to the first group (or first bypass portion) 382*c* adjacent to adjacent to the second compression chamber side discharge port (hereinafter, referred to as a second discharge port) 325*b* and/or the second group (or second bypass portion) 382*b* among the second bypass holes 382*a*, 382*b*, 382*c* may be formed to be larger than a size (d1) of each first bypass hole belonging to the first group (or the first bypass portion) 381*c* adjacent to the first compression chamber side discharge port (hereinafter, referred to as a first discharge port) 325*a* among the first bypass holes 381*a*, 381*b*, 381*c*.

Accordingly, among the bypass holes in each compression chambers (V1, V2) located within a range from the discharge side, namely, the foregoing specific angle (Φ) to the discharge complete angle, an overall cross-sectional area of the second bypass holes 382*a*, 382*b*, 382*c* belonging to the second compression chamber (V2) is formed to be larger than that of the first bypass holes 381*a*, 381*b*, 381*c* belonging to the first compression chamber (V1), and thus even if a compression gradient of the second compression chamber (V2) is relatively larger than that of the first compression chamber (V1), an amount of refrigerant bypassed in the second compression chamber (V2) becomes larger than that bypassed in the first compression chamber (V1). Through this, over-compression loss in the second compression chamber having a relatively larger compression loss may be effectively reduced to enhance the overall efficiency of the compressor.

Figure 9:
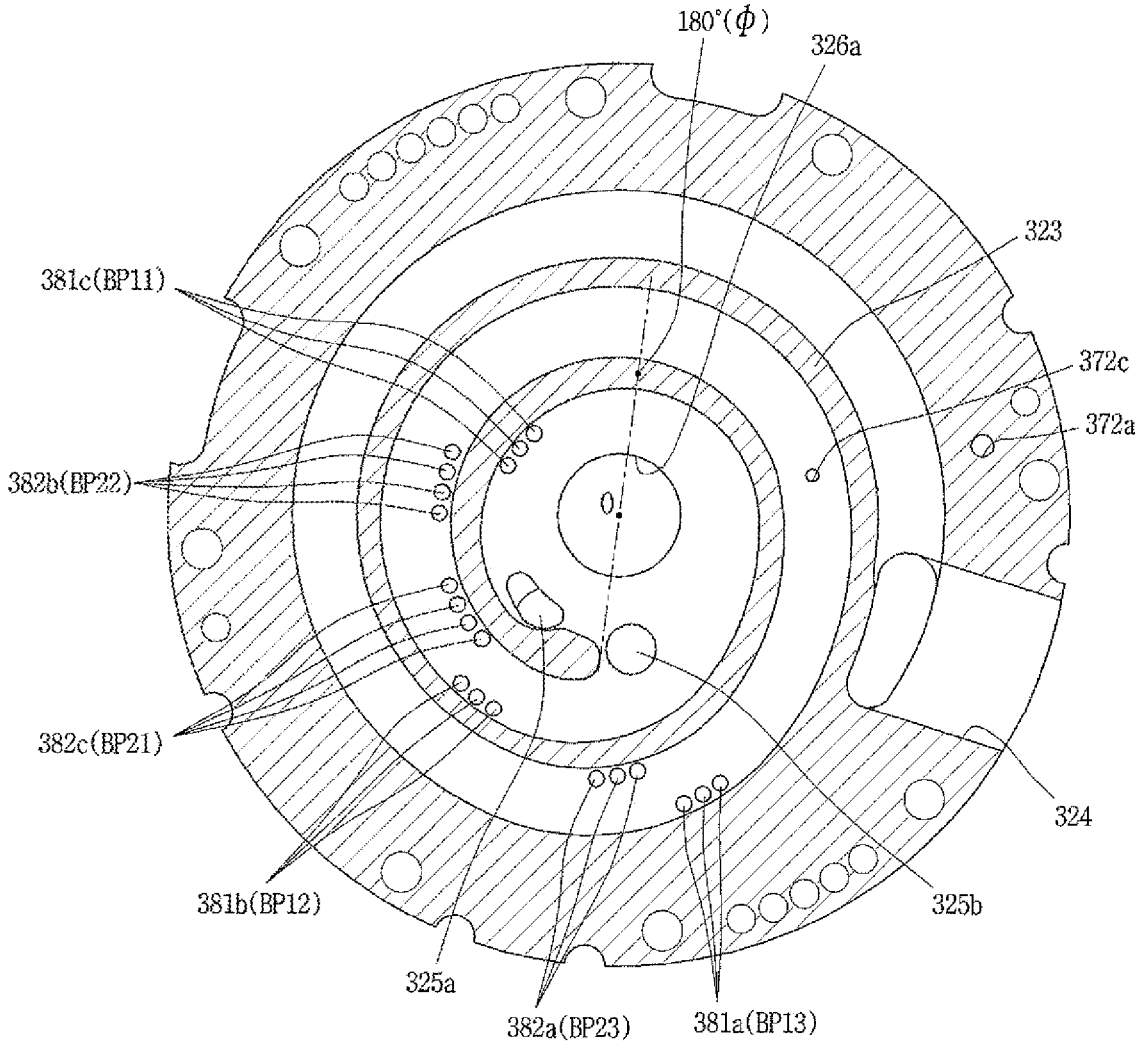

On the other hand, as illustrated in FIG. 9, a number of the bypass holes 382*b*, 382*c* belonging to the first group and/or the second group among the second bypass holes within a range from the foregoing specific angle (Φ) to the discharge complete angle may be formed to be larger than that of the bypass holes 381*c* belonging to the first group among the first bypass holes.

In this case, a size of the first bypass hole 381*c* and a size of the second bypass hole 382*b*, 382*c* may be the same, but as in the above embodiment of FIG. 8, a size (d2) of the second bypass hole 382*b*, 382*c* may be formed to be larger than a size (d1) of the first bypass hole 381*c*. Of course, conversely, the size (d1) of the first bypass hole 381*c* may be formed to be larger than the size (d2) of the second bypass hole 382*b* 382*c*, but in this case, an overall cross-sectional area of the second bypass hole 382*b*, 382*c* should be formed to be larger than that of the first bypass hole 381*c* to reduce over-compression loss in the second compression chamber (V2).

When a number of the second bypass holes 382*b*, 382*c* is formed to be larger than that of the first bypass holes 381*c* within the above range as described above, an effect of reducing over-compression loss in the second compression chamber (V2) while forming an overall cross-sectional area of the second bypass holes 382*b*, 382*c* to be larger than that of the first bypass hole 381*a* is the same as in the above-described embodiments. However, in case of the present embodiment, an overall cross-sectional area of the second bypass hole may be increased while appropriately maintaining a size of the bypass hole, namely, not to be larger than a thickness of the wrap, and thus the present embodiment may be advantageous in terms of processing as compared to the embodiment of FIG. 8.

Figure 10:
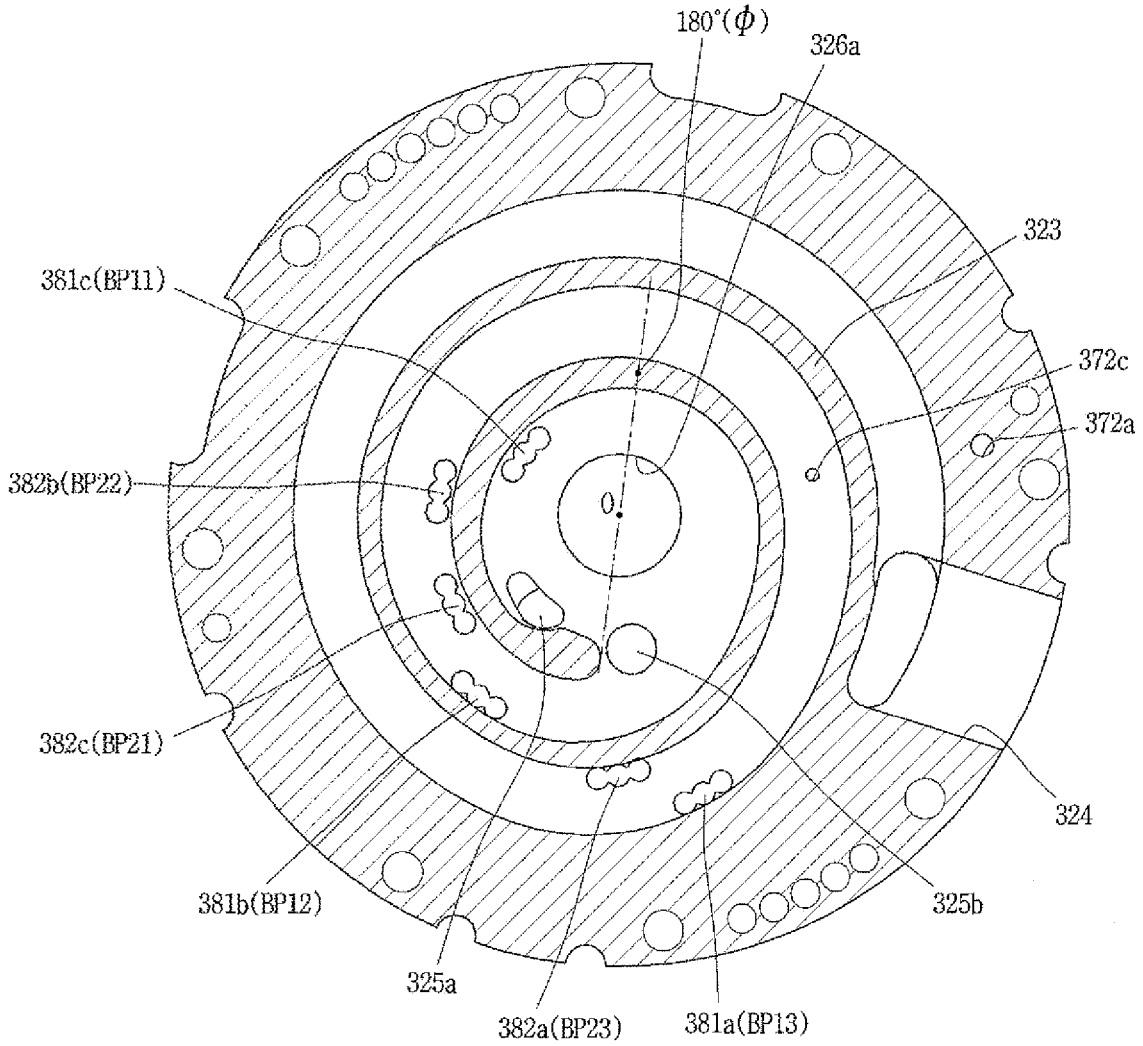

On the other hand, as one first bypass hole 381*c* and two second bypass holes 382*b*, 382*c* are formed within the above range as illustrated in FIG. 10, a number of bypass holes in the first compression chamber (V1) and the second compression chamber (V2) may be formed to be different from each other.

In other words, unlike the above-described embodiments, the present embodiment may form three bypass holes in a long hole shape by connecting three or more bypass holes to one another instead of successively forming the three bypass holes at regular intervals. In this case, it may be possible to form a larger bypass hole in the same area to prevent over compression loss and reduce a passage resistance at the discharge port, thereby further increasing compression efficiency.

What is claimed is:

1. A compressor, comprising:

a casing;

a drive motor provided in an inner space of the casing;

a rotating shaft coupled to the driving motor to rotate;

an orbiting scroll comprising an orbiting end plate coupled to the rotating shaft, and an orbiting wrap extended along a circumference of the orbiting end plate; and a fixed scroll comprising a fixed end plate provided to face the orbiting scroll and a fixed wrap extending from the fixed end plate to engage the orbiting wrap to compress refrigerant, wherein the fixed scroll further comprises:

a suction port penetrating through the fixed end plate to receive the refrigerant and spaced apart from an outermost of the fixed wrap, a discharge port penetrating the fixed end plate to discharge the refrigerant, and spaced apart from an innermost of the fixed wrap, and a bypass portion comprising a first hole portion including holes of bypass hole groups located inside from the fixed wrap with respect to a second shaft receiving hole of the fixed scroll to discharge the refrigerant, and a second hole portion including holes of bypass hole groups located outside far away from the fixed wrap with respect to the second shaft receiving hole of the fixed scroll to discharge the refrigerant, and wherein a total area of the second hole portion is greater than a total area of the first hole portion.

2. The compressor according to claim 1, wherein a diameter of each hole of the bypass hole groups constituting the second hole portion is larger than a diameter of each hole of the bypass hole groups constituting the first hole portion.

3. The compressor according to claim 1, wherein a number of the holes of the bypass hole groups constituting the second hole portion is greater than a number of the holes of the bypass hole groups constituting the first hole portion.

4. The compressor according to claim 1, wherein the first hole portion and the second hole portion are provided in plurality in an extending direction of the fixed wrap, and wherein each interval of the second hole portion is provided smaller than each interval of the first hole portion.

5. The compressor according to claim 1, wherein the first hole portion and the second hole portion are provided in plurality in an extending direction of the fixed wrap, and wherein each minimum interval of the second hole portion is smaller than each minimum interval of the first hole portion.

6. The compressor according to claim 1, wherein the first hole portion and the second hole portion are provided in plurality in an extending direction of the fixed wrap, and wherein each interval of the second hole portions disposed closest to the rotating shaft is smaller than each interval of the first hole portion disposed closest to the rotating shaft.

7. The compressor according to claim 1, wherein a total area of the holes of the bypass hole groups through which the gaseous refrigerant is discharged from the second hole portion is larger than a total area of the holes of the bypass hole groups through which the gaseous refrigerant is discharged from the first hole portion.

8. The compressor according to claim 1, wherein the orbiting end plate comprises a shaft coupling portion coupled to the rotating shaft, wherein the orbiting wrap that extends toward the casing along the circumference of the orbiting end plate from the shaft coupling portion, and wherein the discharge port is provided spaced apart from the shaft coupling portion.

9. A compressor, comprising:

a casing;

a drive motor provided in an inner space of the casing;

a rotating shaft coupled to the driving motor to rotate;

an orbiting scroll comprising an orbiting end plate coupled to the rotating shaft, and an orbiting wrap extended along a circumference of the orbiting end plate; and a fixed scroll comprising a fixed end plate provided to face the orbiting scroll and a fixed wrap extending from the fixed end plate to engage the orbiting wrap to compress refrigerant, wherein the fixed scroll further comprises:

a suction port penetrating through the fixed end plate to receive the refrigerant and spaced apart from an outermost of the fixed wrap, a discharge port penetrating the fixed end plate to discharge the refrigerant, and spaced apart from an innermost of the fixed wrap, and a bypass portion comprising a first hole portion including holes of bypass hole groups located inside from the fixed wrap with respect to a second shaft receiving hole of the fixed scroll to discharge the refrigerant, and a second hole portion including holes of bypass hole groups located outside far away from the fixed wrap with respect to the second shaft receiving hole of the fixed scroll to discharge the refrigerant, and wherein the discharge port is provided to be spaced apart from a center of the fixed end plate.

* * * * *